US012473160B2

(12) United States Patent
Fukada et al.

(10) Patent No.: US 12,473,160 B2
(45) Date of Patent: Nov. 18, 2025

(54) SHEET FEEDING APPARATUS AND IMAGE FORMING APPARATUS

(71) Applicant: CANON KABUSHIKI KAISHA, Tokyo (JP)

(72) Inventors: Ichiro Fukada, Shizuoka (JP); Shunsuke Okazaki, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 262 days.

(21) Appl. No.: 18/199,461

(22) Filed: May 19, 2023

(65) Prior Publication Data

US 2023/0382667 A1 Nov. 30, 2023

(30) Foreign Application Priority Data

May 27, 2022 (JP) ..... 2022-087035

(51) Int. Cl.
*B65H 3/06* (2006.01)

(52) U.S. Cl.
CPC ..... *B65H 3/0684* (2013.01); *B65H 3/0661* (2013.01); *B65H 3/0676* (2013.01); *B65H 2801/03* (2013.01)

(58) Field of Classification Search
CPC ..... B65H 3/0684; B65H 3/0661; B65H 3/34; B65H 2407/21; B65H 2405/324
See application file for complete search history.

(56) References Cited

U.S. PATENT DOCUMENTS 9,126,781 B2 * 9/2015 Aoyama ..... G03G 15/6514
9,242,819 B2 1/2016 Takezawa
9,452,902 B2 9/2016 Koga et al.
10,280,018 B2 5/2019 Kondo
11,530,104 B2 12/2022 Okazaki
11,697,562 B2 7/2023 Fukada

FOREIGN PATENT DOCUMENTS

JP 2005-060059 A 3/2005
JP 2015-086010 A 5/2015
JP 2016-005986 A 1/2016
JP 2017-052575 A 3/2017
JP 2017-193415 A 10/2017

OTHER PUBLICATIONS

Japanese Office Action dated Jun. 25, 2024, in related Japanese Patent Application No. 2022-087035.

* cited by examiner

*Primary Examiner* — Howard J Sanders
(74) *Attorney, Agent, or Firm* — VENABLE LLP

(57) ABSTRACT

A sheet feeding apparatus includes a sheet supporting portion movable between a sheet supporting position and a first storage position. A sheet feed unit includes a sheet feed portion to feed the supported sheet, and an abutment member regulates movement of the sheet in a sheet feed direction by abutting against a downstream end of the sheet. An engagement member turns into an engagement state and a release state. The sheet feed unit is positioned in a sheet feed position or a waiting position and is exposed to an outside of the sheet feeding apparatus when the sheet supporting portion is in the sheet supporting position. The sheet supporting portion includes a pressing portion to turn the engagement member from the engagement state to the release state by pressing the engagement member when the sheet supporting portion moves from the sheet supporting position to the first storage position.

20 Claims, 11 Drawing Sheets

SHEET FEEDING APPARATUS AND IMAGE FORMING APPARATUS

BACKGROUND OF THE INVENTION

Field of the Invention

This disclosure relates to a sheet feeding apparatus feeding a sheet and an image forming apparatus including the sheet feeding apparatus.

Description of the Related Art

Japanese Patent Laid-Open No. 2016-5986 proposes a manual sheet feeding apparatus disposed on a side of a printer body, and including a manual feed tray openable with respect to the printer body and a sheet feeding unit feeding a sheet loaded on the manual feed tray. In this manual sheet feeding apparatus, so as to miniaturize the printer body, when the manual feed tray is closed with respect to the printer body, the sheet feeding unit is stored in an interior of the printer body.

Further, in general, manual sheet feeding apparatuses including an abutment member regulating a position of the sheet in a sheet feed direction by abutting against an end of the sheet loaded on the manual feed tray are known.

In a case where the abutment member is disposed to the manual sheet feeding apparatus described in Japanese Patent Laid-Open No. 2016-5986 above, at a time of storing the sheet feeding unit in the interior of the printer body by closing the manual feed tray, there is the fear that the abutment member may interfere with the sheet feeding unit or the printer body. Therefore, there is the fear that the compact construction of the printer body and the manual sheet feeding apparatus may be inhibited.

SUMMARY OF THE INVENTION

According to a first aspect of the present invention, a sheet feeding apparatus includes an apparatus body, a sheet supporting portion configured to be movably supported with respect to the apparatus body between a sheet supporting position in which the sheet supporting portion is capable of supporting a sheet and a first storage position in which the sheet supporting portion is stored with respect to the apparatus body, and a sheet feed unit including a sheet feed portion configured to feed the sheet supported by the sheet supporting portion in a sheet feed direction, and an abutment member configured to regulate a movement of the sheet to the feed direction by abutting against a downstream end, of the sheet, in the sheet feed direction, the sheet feed unit being movably supported with respect to the apparatus body among a sheet feed position in which the sheet feed portion is capable of feeding the sheet by coming into contact with the sheet supported by the sheet supporting portion, a waiting position in which the sheet feed portion is separated from the sheet supported by the sheet supporting portion, and a second storage position in which the sheet feed unit is stored with respect to the apparatus body. The sheet feed unit is positioned in the sheet feed position or the waiting position and is exposed to an outside of the sheet feeding apparatus in a case where the sheet supporting portion is positioned in the sheet supporting position. The sheet feed unit is positioned in the second storage position and is not exposed to the outside of the sheet feeding apparatus in a case where the sheet supporting portion is positioned in the first storage position. The abutment member moves together with the sheet feed unit so as to be stored in the apparatus body in a case where the sheet feed unit moves from the waiting position to the second storage position.

According to a second aspect of the present invention, a sheet feeding apparatus includes an apparatus body, a sheet supporting portion configured to be movably supported with respect to the apparatus body between a sheet supporting position in which the sheet supporting portion is capable of supporting a sheet and a first storage position in which the sheet supporting portion is stored with respect to the apparatus body, and a sheet feed unit including a feed roller configured to feed the sheet supported by the sheet supporting portion in a sheet feed direction, an abutment member configured to regulate a movement of the sheet to the sheet feed direction by abutting against a downstream end, of the sheet, in the sheet feed direction, and a holding portion configured to hold the feed roller and the abutment member, the sheet feed unit being movably supported with respect to the apparatus body among a sheet feed position in which the feed roller is capable of feeding the sheet by coming into contact with the sheet supported by the sheet supporting portion, a waiting position in which the feed roller is separated from the sheet supported by the sheet supporting portion, and a second storage position in which the sheet feed unit is stored with respect to the apparatus body. The sheet feed unit is positioned in the sheet feed position or the waiting position and is exposed to an outside of the sheet feeding apparatus in a case where the sheet supporting portion is positioned in the sheet supporting position. The sheet feed unit is positioned in the second storage position and is not exposed to the outside of the sheet feeding apparatus in a case where the sheet supporting portion is positioned in the first storage position. The abutment member is positioned with respect to the holding portion in an abutment position in which the abutment member regulates the movement of the sheet supported by the sheet supporting portion to the sheet feed direction, and moves with respect to the holding portion while a positioning of the abutment member with respect to the holding portion is released in a case where the sheet feed unit moves from the waiting position to the second storage position.

Further features of the present invention will become apparent from the following description of exemplary embodiments with reference to the attached drawings.

DESCRIPTION OF THE EMBODIMENTS

First Embodiment

Overall Configuration

First, a first embodiment of this disclosure will be described. A printer 1, serving as an image forming apparatus, is a laser beam printer of an electrophotographic system forming a monochromatic toner image. To be noted, in the following description, a sheet S means a recording material on which the image is formed by the printer 1, and includes, for example, such as paper and an overhead transparency (OHT) sheet.

Figure 1:
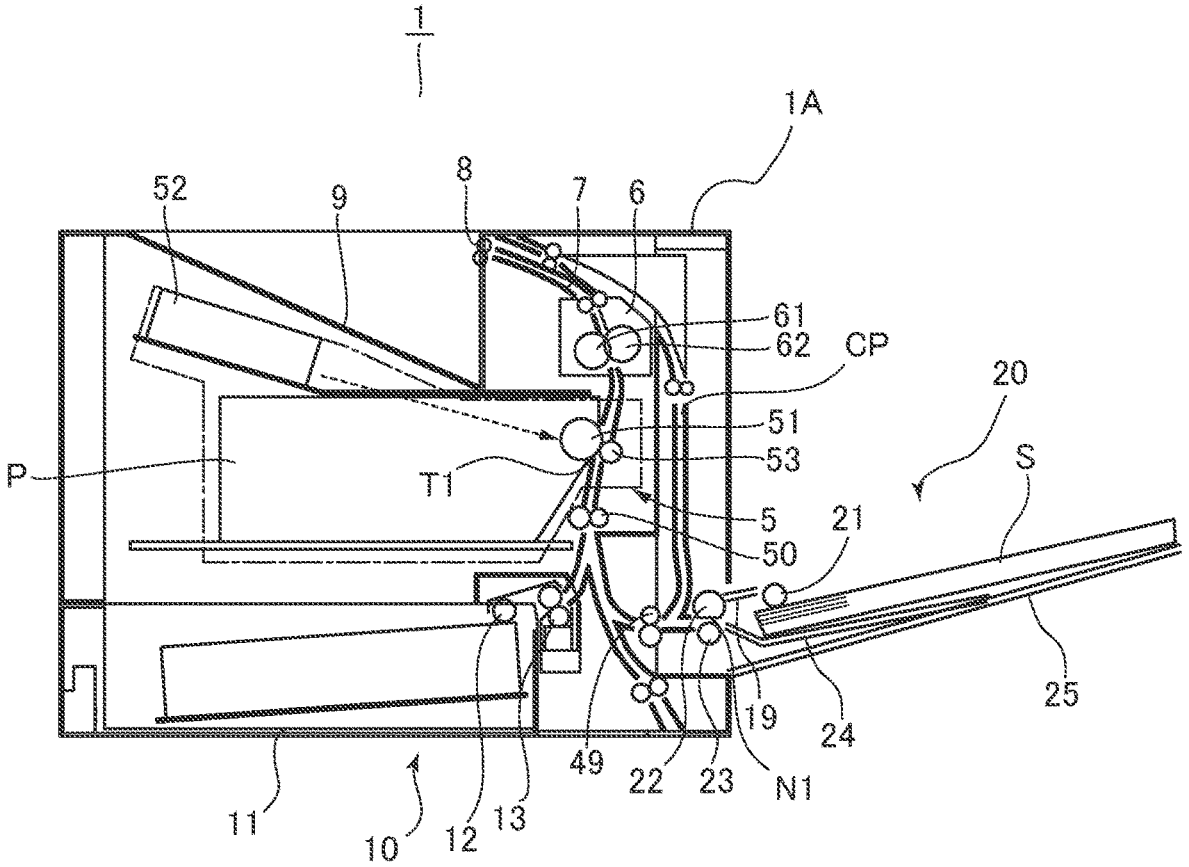
FIG. 1 is an overall schematic diagram illustrating a printer of a first embodiment.

As illustrated in FIG. 1, the printer 1 includes an apparatus body sheet feed unit 10 and a manual sheet feed portion 20. Further, the printer 1 includes an image forming unit 5 forming the image on the sheet fed by the apparatus body sheet feed unit 10 or the manual sheet feed portion 20, a fixing unit 6 fixing the image transferred onto the sheet, and a sheet discharge roller pair 8 capable of discharging the sheet to a sheet discharge tray 9.

When an image forming job has been output to the printer 1, the image forming unit starts an image forming process based on image information input from such as an external computer connected to the printer 1. The image forming unit 5 includes a laser scanner 52, a process cartridge P including a photosensitive drum 51, and a transfer roller 53. A charge roller and a developing roller, not shown, are disposed around the photosensitive drum 51. The photosensitive drum 51 and the transfer roller 53 form a transfer nip T1.

The laser scanner 52 emits a laser beam toward the photosensitive drum 51 based on the input image information. At this time, the photosensitive drum 51 has been charged beforehand by the charge roller, and an electrostatic latent image is formed on the photosensitive drum 51 by being irradiated with the laser beam. Thereafter, this electrostatic latent image is developed by the developing roller, and the monochromatic toner image is formed on the photosensitive drum 51.

In parallel with the image forming process described above, the apparatus body sheet feed unit 10 or the manual sheet feed portion 20 feeds the sheet S. The apparatus body sheet feed unit 10 includes a cassette 11 withdrawable and attachable with respect to an apparatus body 1A of the printer 1, a feed roller 12, and a separation roller pair 13. The sheet S stored in the cassette 11 is fed by the feed roller 12, and the sheet S fed by the feed roller 12 is separated into one sheet at a time by the separation roller pair 13.

Further, the manual sheet feed portion 20, serving as a sheet feeding apparatus, includes a manual feed tray 24 supported by a manual feed cover 25, which is pivotably supported by the apparatus body 1A, a pickup roller 21, and a conveyance roller 22 and a separation roller 23 constituting a separation roller pair. The conveyance roller 22 and the separation roller 23 form a separation nip N1. The sheet S supported by the manual feed tray 24 is fed by the pickup roller 21, serving as a sheet feed unit and a feed roller, and the sheet S fed by the pickup roller 21 is separated into one sheet at a time by the separation nip N1.

To be noted, in the cassette 11 or the manual feed tray 24, it is acceptable to dispose an intermediate plate capable of supporting and lifting the sheet, and, for example, it is acceptable that the intermediate plate is lifted by inputting the image forming job so as to bring the sheet supported by the intermediate plate into contact with the feed roller. Further, with respect to the separation roller pair, it is acceptable that one of a roller pair is a pad or the like, and a torque limiter system or a retard roller system can be applied.

The sheet S sent from the apparatus body sheet feed unit 10 or the manual sheet feed portion 20 is further conveyed by a conveyance roller pair 49 and a registration roller pair 50. Then, the toner image on the photosensitive drum 51 is transferred onto the sheet S in the transfer nip T1 by an electrostatic load bias applied to the transfer roller 53. Residual toner remained on the photosensitive drum 51 is collected by a cleaning blade, not shown. By a fixing film 61 and a press roller 62 of the fixing unit 6, predetermined heat and pressure are provided to the sheet S onto which the toner image has been transferred, so that the toner is melted and bonded (fixed). Inside of the fixing film 61, a heating member such as a ceramic heater is disposed. The sheet S passed through the fixing unit 6 is discharged to the sheet discharge tray 9 by the sheet discharge roller pair 8.

In a case where the image is formed on both surfaces of the sheet S, the sheet on whose first surface the image has been formed is switchbacked by a reverse conveyance roller pair 7, and conveyed to a duplex conveyance path CP. The duplex conveyance path CP guides the sheet S toward the conveyance roller pair 49. Then, the sheet S is again conveyed to the transfer nip T1 by the conveyance roller pair 49 and the registration roller pair 50, so that the image is formed on a second surface in the transfer nip T1, and, then, the sheet S is discharged to the sheet discharge tray 9.

Detailed Configuration of Manual Sheet Feed Portion

Figure 2:
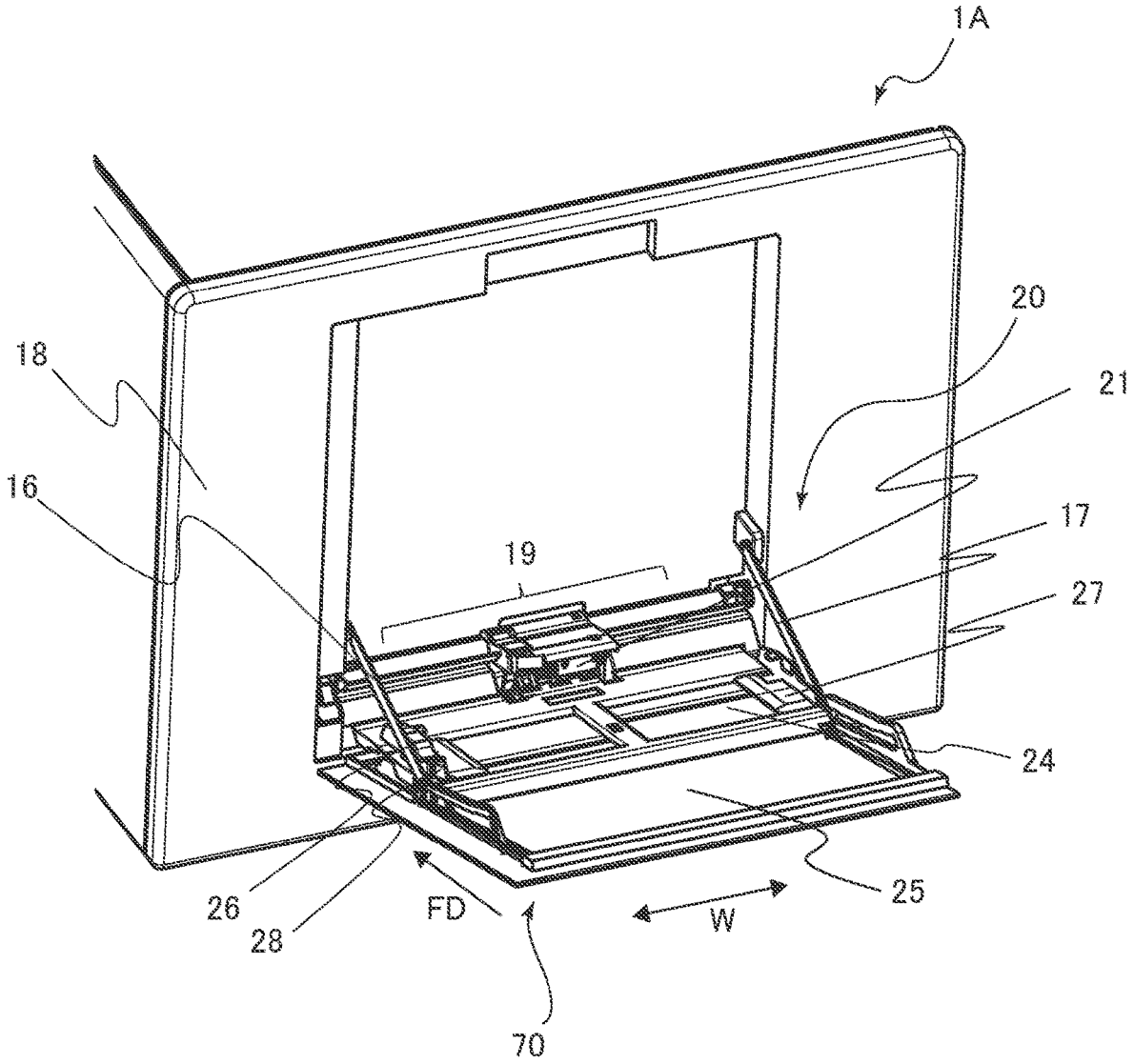
FIG. 2 is a perspective view illustrating a manual sheet feed portion of the printer.

Next, a detailed configuration of the manual sheet feed portion 20 will be described. As illustrated in FIG. 2, the manual sheet feed portion 20 includes a part of the apparatus body 1A, a sheet supporting portion 70, and a sheet feed unit 19 held by the apparatus body 1A and disposed above the sheet supporting portion 70. The sheet supporting portion 70 is supported in a movable (openable) manner between a sheet supporting position (refer to FIG. 2) in which the sheet supporting portion 70 is capable of supporting the sheet and a storage position (refer to FIG. 7B), serving as a first storage position, in which the sheet supporting portion 70 is stored with respect to the apparatus body 1A.

The sheet supporting portion 70 includes the manual feed cover 25, the manual feed tray 24, tray links 16 and 17, and side regulating plates 26 and 27. The manual feed cover 25, serving as a cover, is supported in a manner openable with respect to a right cover 18 of the apparatus body 1A, and constitutes part of an exterior surface of the apparatus. The manual feed tray 24 is held above the manual feed cover 25. The manual feed cover 25 can be positioned at a predetermined degree of opening by the tray links 16 and 17. Further, first ends of the tray links 16 and 17 are linked to the manual feed tray 24, and the manual feed tray 24 is movable along the manual feed cover 25 in conjunction with an opening/closing operation of the manual feed cover 25.

The manual feed tray 24 movably supports the side regulating plates 26 and 27 in a width direction W perpendicularly intersecting with a feed direction FD of the sheet S, and an operation lever 28 is disposed to the side regulating plate 26. The side regulating plates 26 and 27 are linked by an interlock mechanism, not shown, so as to move in directions opposite to each other in the width direction W. Then, when a user sets the sheet S on the manual feed tray 24, the user regulates positions of both ends of the sheet S in the width direction W by grasping the operation lever 28 and moving the side regulating plates 26 and 27.

Sheet Feed Unit

Figure 3:
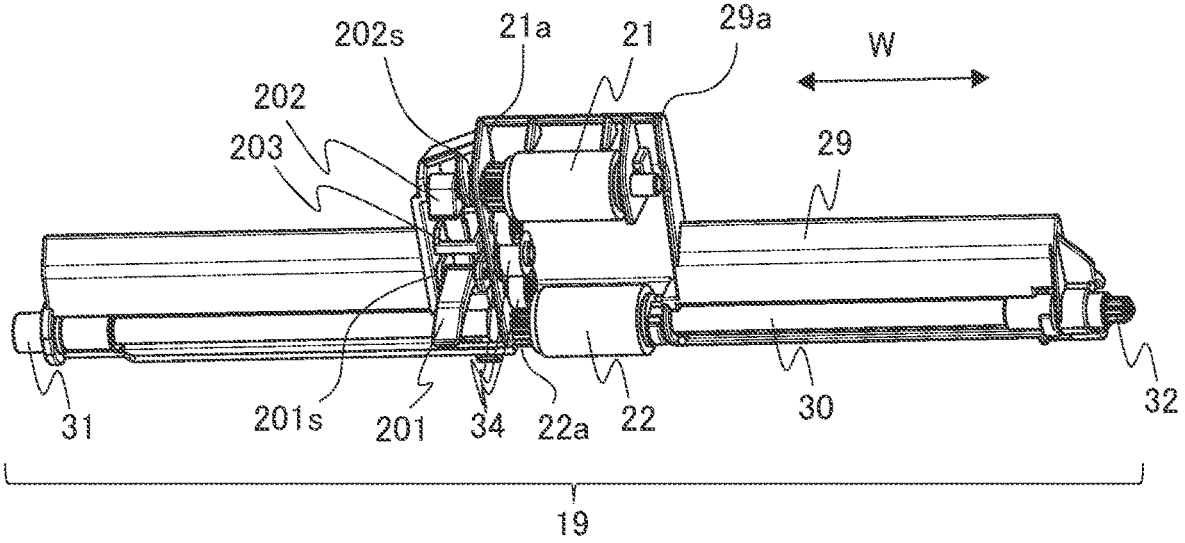
FIG. 3 is a perspective view illustrating the manual sheet feed portion.
Figure 4A:
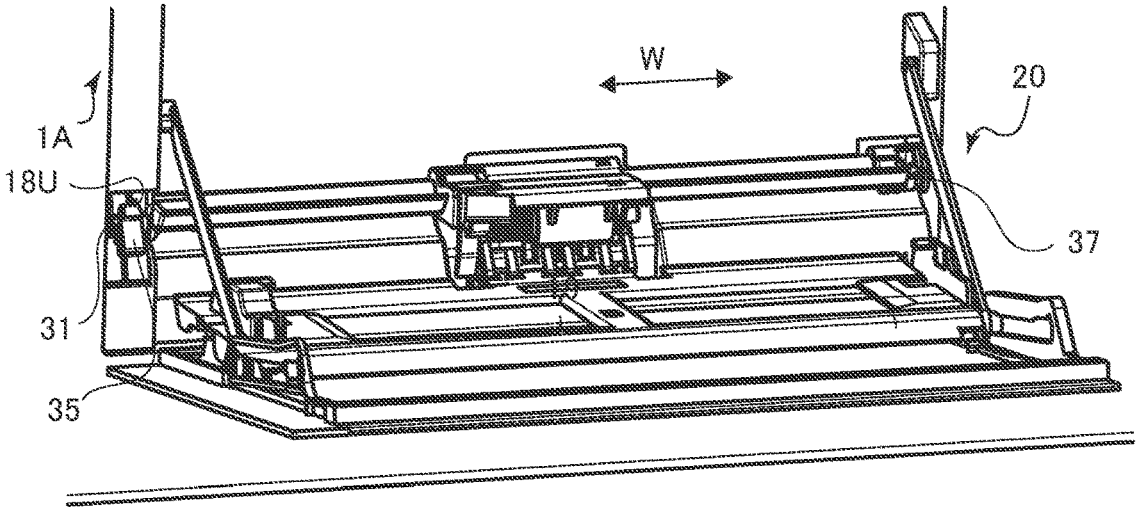
FIG. 4A is a perspective view illustrating the manual sheet feed portion.

Next, using FIGS. 3 to 4C, the sheet feed unit 19 will be described in detail. As illustrated in FIGS. 3 and 4A, the sheet feed unit 19 includes a feed bearing 31, a feed coupling 32, a feed shaft 30, serving as a rotation shaft, a pickup arm 29, the pickup roller 21, and the conveyance roller 22. Further, the sheet feed unit 19 includes an abutment member 201, an abutment regulation member 202, and a movement regulation member 203.

The feed bearing 31 is held by the right cover 18 of the apparatus body 1A, and relatively rotatably supports the feed shaft 30. The feed coupling 32 is disposed to the feed shaft 30 at an end opposite to the feed bearing 31. The conveyance roller 22, serving as a conveyance rotary member, is secured to a substantially central portion of the feed shaft 30 in the width direction W, and a feed gear 22*a* is disposed to a first end of the conveyance roller 22.

Further, the pickup arm 29 is pivotably supported by the feed shaft 30, and a roller holding portion 29*a* rotatably supporting the pickup roller 21 is disposed in a substantially central portion of the pickup arm 29 in the width direction W.

A pickup gear 21*a* is disposed to a first end of the pickup roller 21. A gear train 34 is rotatably supported by the roller holding portion 29*a*, and engages with the feed gear 22*a* and the pickup gear 21*a*. Thereby, when the feed shaft 30 rotates, the conveyance roller 22 rotates, and the rotation of the feed gear 22*a* is transmitted to the pickup gear 21*a* by the gear train 34, so that the pickup roller 21 also rotates.

The movement regulation member 203 is relatively rotatably supported with respect to the feed shaft 30, and adjacently arranged to the roller holding portion 29*a* of the pickup arm 29 in the width direction. To be noted, the movement regulation member 203 is pivotable independently from the pickup arm 29.

The abutment member 201 is pivotably supported by the movement regulation member 203 around a pivot shaft 201*s*. Further, the abutment regulation member 202 is pivotably supported by the roller holding portion 29*a* of the pickup arm 29 around a pivot shaft 202*s*. An operation of the sheet feed unit 19 will be described below. To be noted, the pivot shaft 202*s* is coaxial with a rotation center of the pickup roller 21.

In an abutment position, described below, the abutment member 201 abuts against a downstream end of the sheet S supported by the sheet supporting portion 70 in the feed direction FD of the sheet S so as to regulate the movement of the sheet S in the feed direction FD.

Figure 4B:
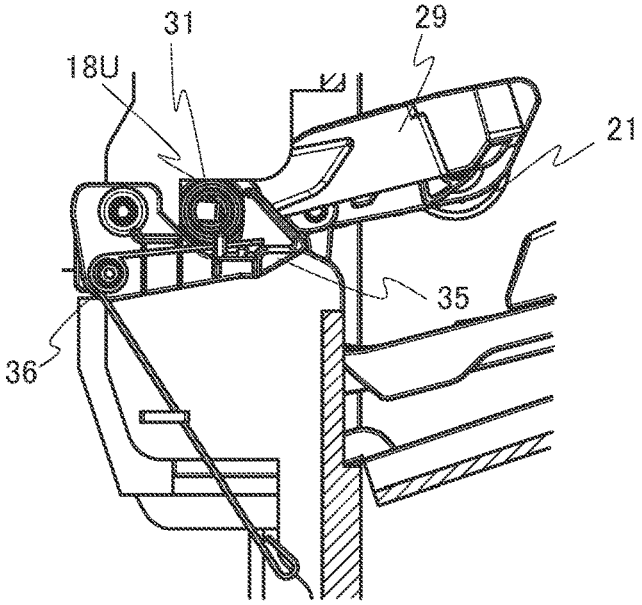
FIG. 4B is a side view illustrating a configuration for holding the manual sheet feed portion.

As illustrated in FIG. 4A, a groove 18U is disposed in the right cover 18 of the apparatus body 1A, and engages with the feed bearing 31 of the sheet feed unit 19. Further, a hook-shaped latch 35 is pivotably supported by the right cover 18, and, as illustrated in FIG. 4B, the latch 35 is urged upward by a torsion spring 36. Thereby, the detachment of the feed bearing gear 31 engaged with the groove 18U is prevented by the latch 35.

Figure 4C:
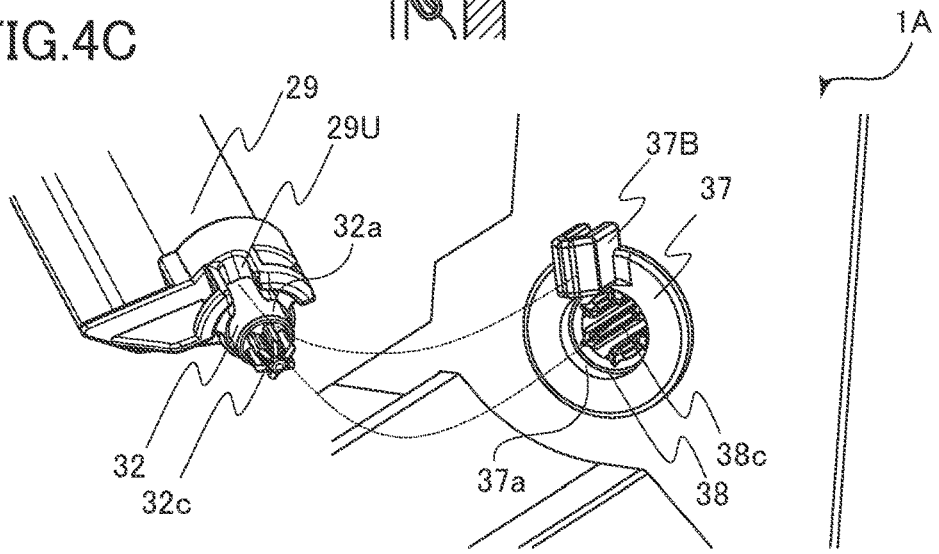
FIG. 4C is an assembly perspective view illustrating a feed coupling and an arm pivot lever.

As illustrated in FIGS. 4A and 4C, an arm pivot lever 37 and a feed gear 38 are disposed on the other side of the latch 35 in the width direction W of the apparatus body 1A. The arm pivot lever 37 is formed substantially in a cylindrical shape, and includes an inner circumferential surface 37*a*. A coupled portion 38*c* is disposed in the feed gear 38 adjacently to the inner circumferential surface 37*a* of the arm pivot lever 37.

An outer circumferential surface 32*a* of the feed coupling 32 disposed at a first end of the feed shaft 30 is rotatably supported by the inner circumferential surface 37*a* of the arm pivot lever 37. Then, a coupling portion 32*c* engaging with the coupled portion 38*c* of the feed gear 38 is disposed at an end of the feed coupling 32. By engaging the coupled portion 38*c* and the coupling portion 32*c*, the rotation of the feed gear 38 is transmitted to the feed shaft 30.

Further, a protrusion portion 37B is disposed on the arm pivot lever 37. A groove 29U arranged adjacently to the feed coupling 32 is disposed in the pickup arm 29, and engages with the protrusion portion 37B. While details will be described below, by engaging the protrusion portion 37B and the groove 29U, the pickup arm 29 pivots around the feed shaft 30 in conjunction with the arm pivot lever 37. Thereby, the pickup roller 21 rotatably supported by the pickup arm 29 comes into contact with and is separated from the sheet S supported by the manual feed tray 24.

To be noted, the feed bearing 31 and the feed coupling 32 of the sheet feed unit 19 is detachable with respect to the apparatus body 1A. That is, the sheet feed unit 19 is attachable to and detachable from the apparatus body 1A.

Drive Transmission Mechanism

Next, using FIGS. 5A and 5B, a drive transmission mechanism 60 for transmitting drive from a drive motor M disposed in the apparatus body 1A to the feed shaft 30 and the pickup arm 29 will be described.

Figure 5A:
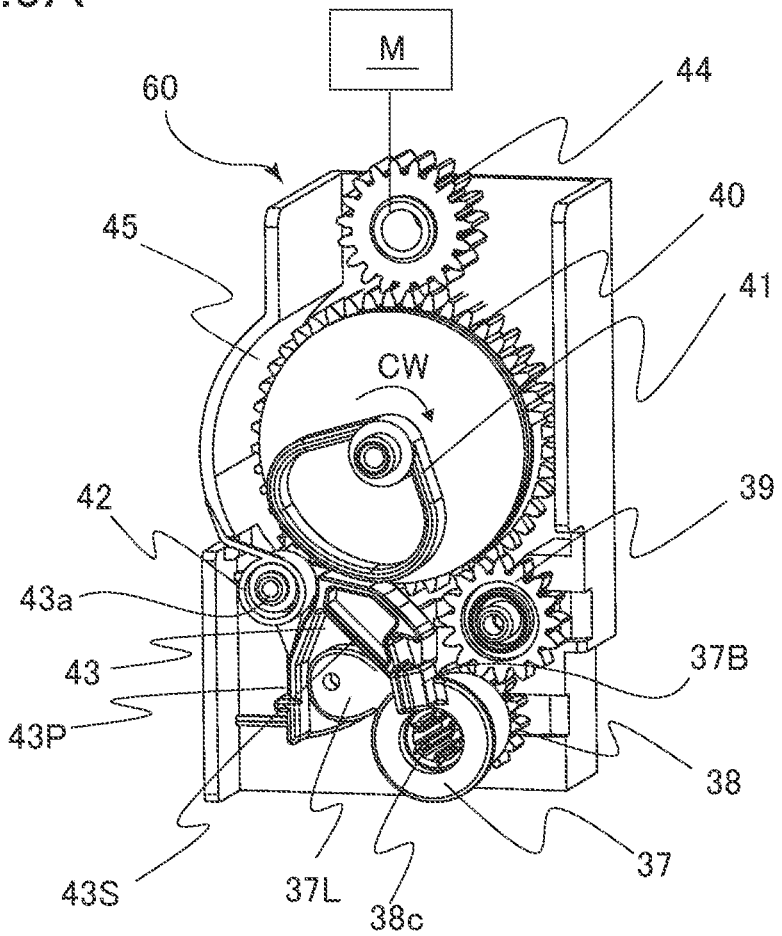
FIG. 5A is a perspective view illustrating a drive transmission mechanism.
Figure 5B:
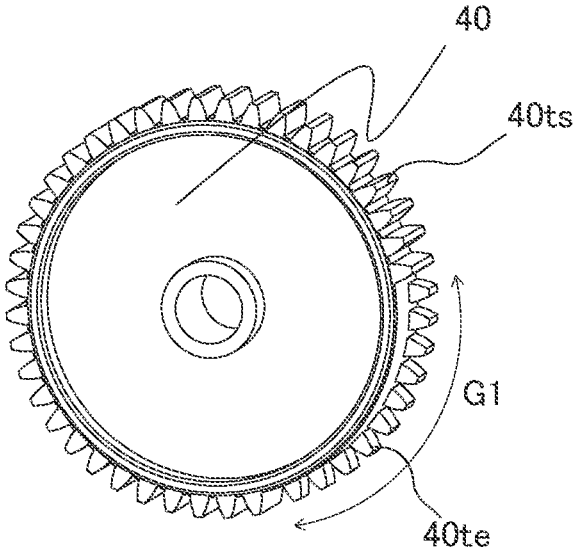
FIG. 5B is a perspective view illustrating a partially toothless gear.

As illustrated in FIG. 5A, the drive transmission mechanism 60 is disposed in an interior of the right cover 18 (refer to FIG. 2). The drive transmission mechanism 60 includes a drive frame 45, an input gear 44 rotatably supported by the drive frame 45, a partially toothless gear 40 and a feed idler gear 39, the feed gear 38, a press arm 43, and a torsion spring 42.

The input gear 44 is driven by the drive motor M. While, as illustrated in FIG. 5B, teeth are formed over the whole circumference of the partially toothless gear 40, the partially toothless gear 40 includes a plurality of teeth 40*ts* having a first tooth width, and a plurality of teeth 40*te* having a second tooth width narrower than the first tooth width. The teeth 40*te* are formed only in a region G1, and the teeth 40*ts* are formed in the other region.

The teeth 40*ts* having the wider tooth width can engage with both of the input gear 44 and feed idler gear 39. The teeth 40*te* having the narrower tooth width can engage with the input gear 44, but do not engage with the feed idler gear 39. That is, the partially toothless gear 40 does not engage with the feed idler gear 39 in the region G1, and, at this time, the rotation of the partially toothless gear 40 is not transmitted to the feed idler gear 39.

As illustrated in FIG. 5A, the press arm 43 is pivotably supported with respect to the drive frame 45 around a pivot shaft 43*a*, and the torsion spring 42 urging the press arm 43 in a counter-clockwise direction in FIG. 5A is disposed around the pivot shaft 43*a*. A separation rib 43S and a press rib 43P are disposed to the press arm 43. A lever 37L is disposed to the arm pivot lever 37, and the lever 37L is disposed between the separation rib 43S and the press rib 43P.

Further, a control cam 41 integrally rotating with the partially toothless gear 40 is coaxially disposed with the partially toothless gear 40, and can press the press arm. Then, by rotating the control cam 41 together with the partially toothless gear 40, the control cam 41 presses the press arm 43 while resisting the urging force of the torsion spring 42. Thereby, along with a pivot of the press arm 43, the lever 37L disposed between the separation rib 43S and the press rib 43P swings, and the arm pivot lever 37 pivots. Since the protrusion portion 37B and the groove 29U engage with each other when the arm pivot lever 37 pivots, the pickup arm 29 pivots around the feed shaft 30.

Feed Operation of Sheet Feed Unit

Figure 6A:
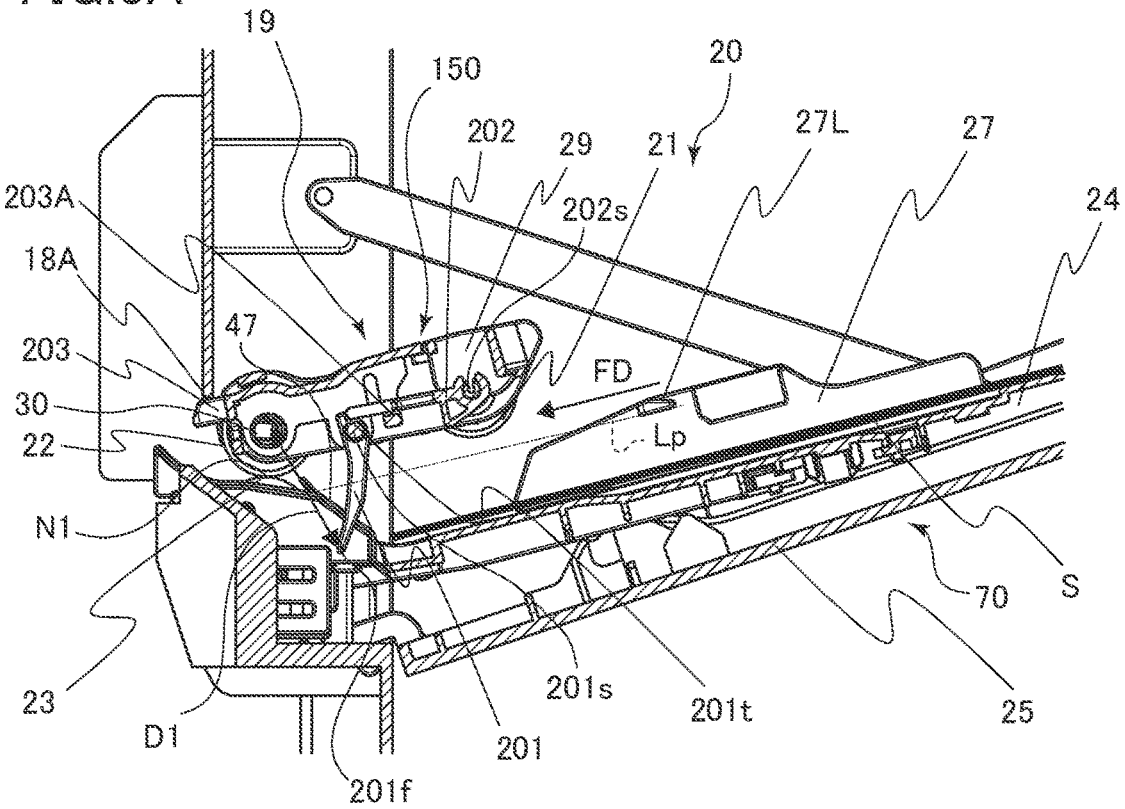
FIG. 6A is a cross-sectional view illustrating a sheet feed unit positioned in a waiting position.
Figure 6B:
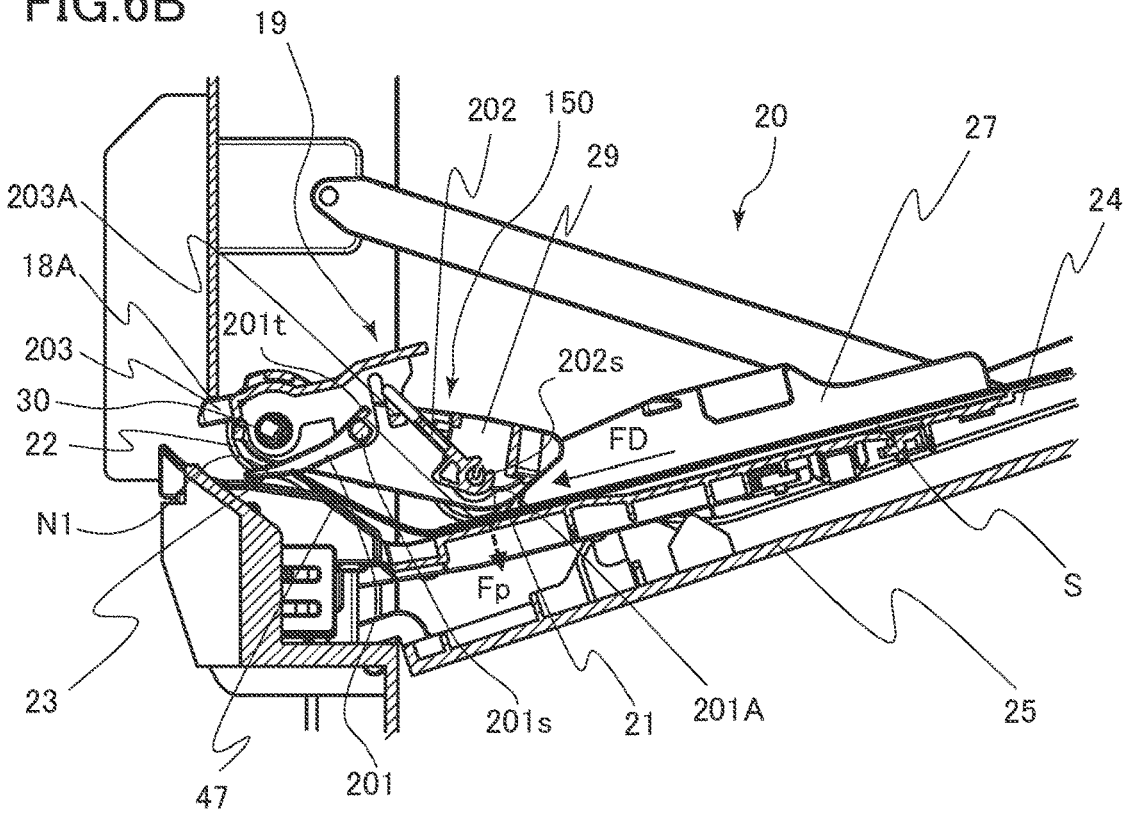
FIG. 6B is a cross-sectional view illustrating the sheet feed unit positioned in a sheet feed position.

Next, using FIGS. 6A and 6B, a feed operation of the sheet feed unit 19 will be described. FIG. 6A is a cross-sectional view illustrating a state where the sheet feed unit 19 is positioned in a waiting position, and FIG. 6B is a cross-sectional view illustrating a state where the sheet feed unit 19 is positioned in a sheet feed position. To be noted, the sheet feed unit 19 is positioned in the waiting position in a state attached with respect to the apparatus body 1A. Further, the manual feed cover 25 is opened with respect to the apparatus body 1A when the sheet feed unit 19 is positioned in either the waiting position or the sheet feed position. That is, the sheet supporting portion 70 is positioned in a sheet supporting position capable of supporting the sheet.

First, using FIG. 6A, a state of the sheet feed unit 19 before starting a feed operation of feeding the sheet S will be described. For example, in a state where the sheet supporting portion is opened with respect to the apparatus body 1A and a print job has not been input, the sheet feed unit 19 is positioned in the waiting position illustrated in FIG. 6A. At this time, the pickup roller 21 is arranged above a sheet position Lp (indicated by a dashed line in FIG. 6A) corresponding to a full load upper limit claw 27L disposed to the side regulating plate 27.

In particular, when the sheet feed unit 19 is positioned in the waiting position, the pickup arm 29 is positioned in an elevated position. The pickup roller 21 supported by the pickup arm 29 positioned in the elevated position is separated from the sheet supported by the manual feed tray 24. At this time, the abutment member 201 is locked in the abutment position by the abutment regulation member 202.

The movement regulation member 203 is, as described above, pivotable around the feed shaft 30 independently from the pickup arm 29, and is urged in a clockwise direction in FIG. 6A by its own weight. Then, by abutting against a right cover abutment portion 18A disposed in the right cover 18, the movement regulation member 203 is positioned in a position illustrated in FIG. 6A. To be noted, it is acceptable to urge the movement regulation member 203 in the clockwise direction not by its own weight but by an urging member such as a spring.

A contact portion 203A is disposed on the movement regulation member 203, serving as a holding member, and the abutment regulation member 202, serving as an engagement member, is held in an engagement state locking the abutment member 201 in the abutment position by coming into contact with the contact portion 203A. The abutment member 201 can turn to the engagement state and a released state where the lock of the abutment member 201 in the abutment position, described below, is released. Even if the abutment member 201 tries to pivot in the clockwise direction around the pivot shaft 201*s*, the abutment regulation member 202, which is in the engagement state, regulates the pivot of the abutment member 201 by coming into contact with a contact portion 201*t* of the abutment member 201.

To be noted, while, in a state where the pickup arm 29 is positioned in the elevated position, the abutment regulation member 202 is urged in a counter-clockwise direction by its own weight so as to come into contact with the contact portion 203A, it is not limited to this. For example, it is acceptable to dispose an urging member such as a spring which urges the abutment regulation member 202 in the counter-clockwise direction.

As described above, when the sheet feed unit 19 is positioned in the waiting position, the abutment member 201 is locked in the abutment position regulating the movement of the sheet S supported by the sheet supporting portion 70 to the feed direction FD. Thereby, a rush of the sheet S supported by the sheet supporting portion 70 to the separation nip N1 is suppressed, and it is possible to reduce defective conveyance such as double feeding. Therefore, it is possible to realize a stable feed operation.

For example, when the print job has been input and the feed operation has been started, the drive motor M is driven, and the input gear 44 rotates, so that, as illustrated in FIG. 5A, the partially toothless gear 40 rotates in a clockwise direction CW. To be noted, during the execution of the print job, the drive of the drive motor M is maintained. Further, in a state of the drive transmission mechanism 60 illustrated in FIG. 5A, the sheet feed unit 19 is positioned in the waiting position as illustrated in FIG. 6A.

When the partially toothless gear 40 rotates in the clockwise direction CW, also the control cam 41 rotates in the clockwise direction CW integrally with the partially toothless gear 40. Thereby, the control cam 41 is separated from the press arm 43, and the press arm 43 pivots around the pivot shat 43*a* in the counter-clockwise direction by the urging force of the torsion spring 42. Then, the press rib 43P of the press arm 43 presses the lever 37L disposed to the arm pivot lever 37 upward, and the arm pivot lever 37 pivots in the clockwise direction.

When the arm pivot lever 37 pivots in the clockwise direction, by the engagement of the protrusion portion 37B with the groove 29U, the pickup arm 29 pivots around the feed shaft in the clockwise direction in FIG. 6B. Thereby, as illustrated in FIG. 6B, the pickup arm 29 descends from the elevated position, and the pickup roller 21 supported by the pickup arm 29 comes into contact with the sheet S with a contact pressure Fp. A position of the pickup arm 29 at this time is referred to as a lowered position, and a position of the sheet feed unit 19 is referred to as the sheet feed position. That is, when the sheet feed unit 19 is positioned in the sheet feed position, the pickup roller 21 comes into contact with the sheet S, and can feed the sheet S.

Further, by pivoting the pickup arm 29 from the elevated position to the lowered position, the abutment regulation member 202 pivots in the clockwise direction while sliding on the contact portion 203A. This is because the abutment regulation member 202 is pivotably supported by the pickup arm 29 around the pivot shaft 202*s* and, on the other hand, the contact portion 203A is disposed on the movement regulation member 203. Thus, by pivoting the abutment regulation member 202 around the pivot shaft 202*s* in the clockwise direction, the abutment regulation member 202 is separated from the contact portion 201*t* of the abutment member 201. Therefore, the abutment regulation member 202 turns from the engagement state to a release state releasing the lock of the abutment member 201 in the abutment position. That is, when the sheet feed unit 19 moves from the waiting position to the sheet feed position, by being pressed by the contact portion 203A of the movement regulation member 203, the abutment regulation member 202 turns from the engagement state to the release state.

Further, as illustrated in FIG. 5A, by driving the drive motor M, driving force is transmitted to the feed gear 38 via the partially toothless gear 40 and the feed idler gear 39. Then, by the engagement of the coupled portion 38*c* of the feed gear 38 with the coupling portion 32*c* of the feed coupling 32, the feed shaft 30, the conveyance roller 22, and the pickup roller 21 rotate.

Therefore, the sheet S coming into contact with the pickup roller 21 with the contact pressure Fp is fed by the pickup roller 21, and, as illustrated in FIG. 6B, climbs a conveyance guide 47 and is guided to the separation nip N1. The sheet S presses the abutment member 201 positioned in the abutment position, and is conveyed to the downstream side in the feed direction FD by the separation nip N1. As described above, since, by lowering the pickup arm 29 to the lowered position, the abutment regulation member 202 has turned to the release state, it becomes possible to convey the sheet S with the sheet S pushing the abutment member 201 upward.

When, by further rotating the drive motor M, the control cam 41 has come into contact with the press arm 43 again, the press arm 43 pivots in the clockwise direction in FIG. 5A by the control cam 41 while resisting the urging force of the torsion spring 42. Thereby, the press rib 43P of the press arm 43 is separated from the lever 37L, and the separation rib 43S comes into contact with the lever 37L. Then, the separation rib 43S presses the lever 37L downward, and the arm pivot lever 37 pivots in the counter-clockwise direction.

When the arm pivot lever 37 has pivoted in the counter-clockwise direction, by the engagement of the protrusion portion 37B with the groove 29U, the pickup arm 29 pivots around the feed shaft 30 in the counter-clockwise direction in FIG. 6B. Thereby, as illustrated in FIG. 6A, the pickup arm 29 ascends from the lowered position to the elevated position, and the sheet feed unit 19 again returns to the waiting position.

As described above, the sheet feed unit 19 feeds the sheet loaded on the manual feed tray 24 one sheet at a time until the print job is complete. In particular, the pickup roller 21 ascends and descends every time when feeding one sheet of the sheet, and feeds the sheet S when coming into contact with the sheet S with the contact pressure Fp. Further, the lock of the abutment member 201 in the abutment position is released by the descent of the pickup roller 21, and the abutment member 201 is pusher upward by the sheet S. Therefore, the abutment member 201 does not inhibit the feeding of the sheet S. When the print job is complete, the drive motor M stops in a state where the sheet feed unit 19 is positioned in the waiting position.

Storage of Sheet Feed Unit

Next, using FIGS. 7A and 7B, a configuration for storing the sheet feed unit 19 in the apparatus body 1A will be described. As illustrated in FIG. 6A described above, in the state where the sheet feed unit is positioned in the waiting position, the sheet supporting portion 70 is positioned in the sheet supporting position opened with respect to the apparatus body 1A. At this time, the abutment member 201 is positioned with respect to a holding portion 150 including the pickup arm 29 and the movement regulation member 203 so as to be positioned in the abutment position (refer to FIGS. 6A and 6B and FIGS. 7A and 7B). The holding portion 150 holds the pickup roller 21 and the abutment member 201.

Figure 7A:
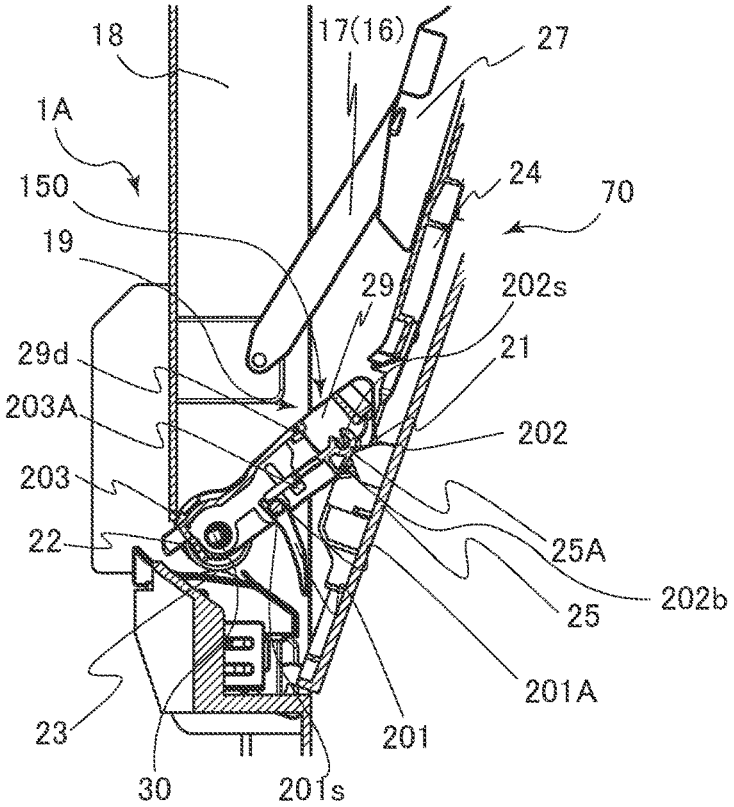
FIG. 7A is a cross-sectional view illustrating a state of the sheet feed unit on the way to being stored in an interior of the apparatus body.
Figure 7B:
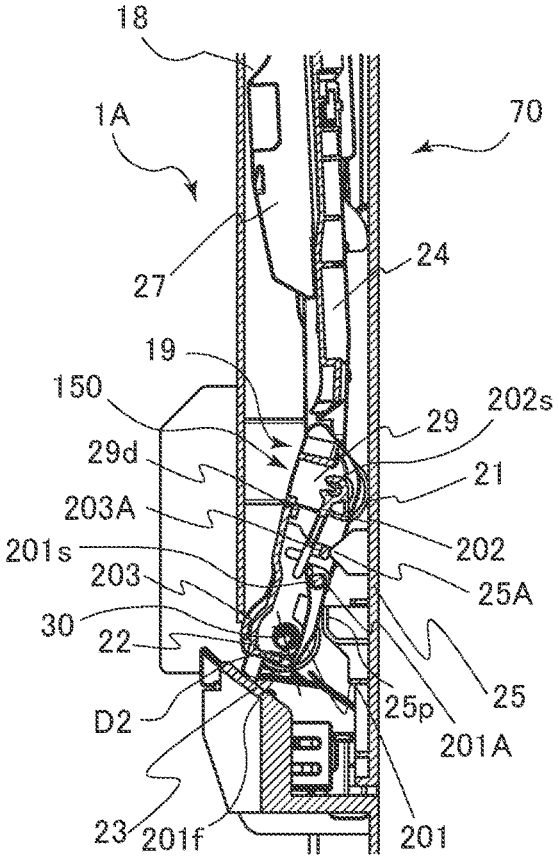
FIG. 7B is a cross-sectional view illustrating a state of the sheet feed unit stored in the interior of the apparatus body.

Then, as illustrated in FIG. 7A, when closing the sheet supporting portion 70 with respect to the apparatus body 1A from the sheet supporting position toward a storage position (refer to FIG. 7B), the manual feed tray 24 is slidingly moved along the manual feed cover 25 upward by the tray links 16 and 17. Thereby, space for storing the sheet feed unit 19 is created.

Further, when closing the sheet supporting portion 70 with respect to the apparatus body 1A in the counter-clockwise direction, the manual feed cover 25 comes into contact with the pickup arm 29, and also the pickup arm 29 pivots around the feed shaft 30 in the counter-clockwise direction. As illustrated in FIG. 7A, when the pickup arm 29 has pivoted around the feed shaft 30 in the counter-clockwise direction, an abutment portion 29*d* disposed to the pickup arm 29 abuts against the movement regulation member 203. In this state, when the pickup arm 29 further pivots around the feed shaft 30 in the counter-clockwise direction, also the movement regulation member 203 pivots around the feed shaft 30 in the counter-clockwise direction together with the pickup arm 29.

At this time, when the manual feed cover 25 has exceeded a certain closing angle, a mountain-shaped rib 25A, serving as a pressing portion, disposed on the manual feed cover 25 starts coming into contact with the abutment regulation member 202. Then, by being pressed by the mountain-shaped rib 25A pivoting together with the manual feed cover 25, the abutment regulation member 202 pivots with respect to the pickup arm 29 around the pivot shaft 202S.

Thereby, the abutment regulation member 202 turns from the engagement state locking the abutment member 201 in the abutment position to the release state releasing the lock, and the pivot regulation of the abutment member 201 is released. Then, the abutment member 201 pivots around the pivot shaft 201*s* in the clockwise direction by its own weight or being pressed by a pressing portion 25*p* of the manual feed cover 25, and, as illustrated in FIG. 7B, is stored in the interior of the apparatus body 1A together with the sheet feed unit 19. A position of the sheet feed unit 19 at this time is referred to as a storage position, serving as a second storage position, and a position of the abutment member 201 at this time is referred to as a storage position, serving as a third storage position. In other words, when the sheet feed unit 19 moves from the waiting position to the storage position, the abutment member 201 moves together with the sheet feed unit 19 so as to be stored in the apparatus body 1A. That is, when the sheet feed unit 19 moves from the waiting position to the storage position, the abutment member 201 moves with respect to the holding portion 150 with positioning with respect to the holding portion 150 released. Further, the sheet feed unit 19 is pivotable around the feed shaft 30 to the sheet feed position, the waiting position, and the storage position. To be noted, when the sheet supporting portion 70 is positioned in the sheet supporting position, the sheet feed unit 19 is positioned in the sheet feed position or the waiting position, and is exposed to the outside of the manual sheet feed portion 20. Further, when the sheet supporting portion 70 is positioned in the storage position, the sheet feed unit 19 is positioned in the storage position, and is not exposed to the outside of the manual sheet feed portion 20.

Here, when viewed in an axial direction of the feed shaft 30, that is, in the width direction W, as illustrated in FIG. 6A, a distance between a tip 201*f* of the abutment member 201 positioned in the abutment position and an axial center of the feed shaft 30 is referred to as a distance D1. The tip 201*f* is a portion farthest from the pivot shaft 201*s* in the abutment member 201. Further, as illustrated in FIG. 7B, a distance between the tip 201*f* of the abutment member 201 positioned in the storage position and the axial center of the feed shaft 30 is a distance D2. The distance D2 is shorter than the distance D1. To be noted, while, in this embodiment, the distances D1 and D2 are the distances between the tip 201*f* and the axial center of the feed shaft if distances between the tip 201*f* and an outer circumferential surface of the feed shaft 30 are treated as the distances D1 and D2, the distance D2 becomes shorter than the distance D1.

As described above, when pivoting the sheet supporting portion 70 and the sheet feed unit 19 to the storage position, the abutment member 201 pivots toward the feed shaft 30 so as to fit within a volume of the pickup arm 29 and the movement regulation member 203. That is, since, in conjunction with the pivot (movement) of the sheet feed unit 19 from the waiting position to the storage position, the abutment member 201 pivots from the abutment position to the storage position, it is possible to compactly store the sheet feed unit 19, including the abutment member 201, in the apparatus body 1A. Therefore, it is possible to compactify the apparatus body 1A.

Further, in a state where the sheet feed unit 19 is positioned in the waiting position as illustrated in FIG. 6A, the abutment member 201 is securely locked in the abutment position by the abutment regulation member 202 which is in the engagement state. Thereby, the rush of the sheet S supported by the manual feed tray 24 to the separation nip N1 is suppressed, and it is possible to reduce the defective conveyance.

Further, the sheet feed unit 19 is attachable to and detachable from the apparatus body 1A, and the abutment member 201 is disposed in the sheet feed unit 19. Therefore, if, for example, the user pushes the sheet S with respect to the abutment member 201, which is locked in the abutment position, with excessive force and the abutment member 201 is deformed or damaged, it is possible to easily replace the abutment member 201 and improve maintainability.

Second Embodiment

While, next, a second embodiment of this disclosure will be described, a configuration of the sheet feed unit of the first embodiment is changed in the second embodiment. Therefore, configurations similar to the first embodiment will be described by omitting illustrations herein or by putting the same reference characters on drawings.

Sheet Feed Unit

Figure 8:
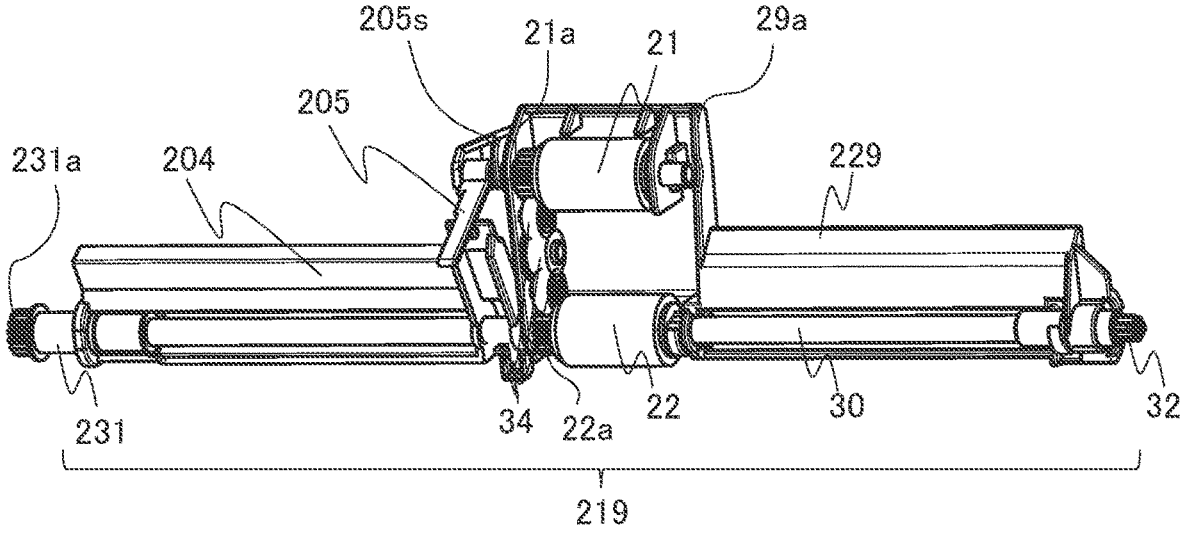
FIG. 8 is a perspective view illustrating a manual sheet feed portion of a second embodiment.
Figure 9A:
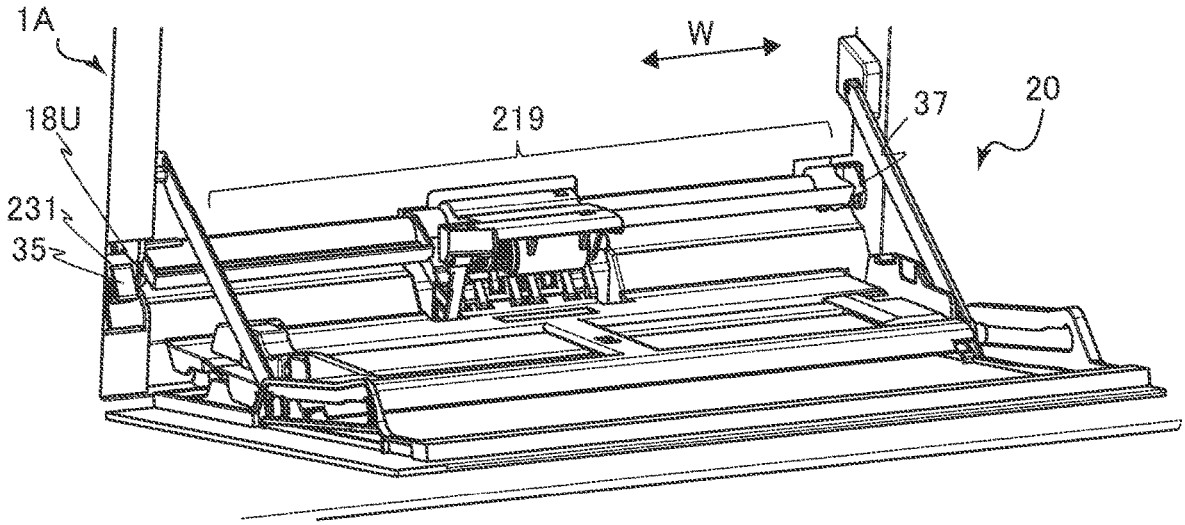
FIG. 9A is a perspective view illustrating the manual sheet feed portion.
Figure 9B:
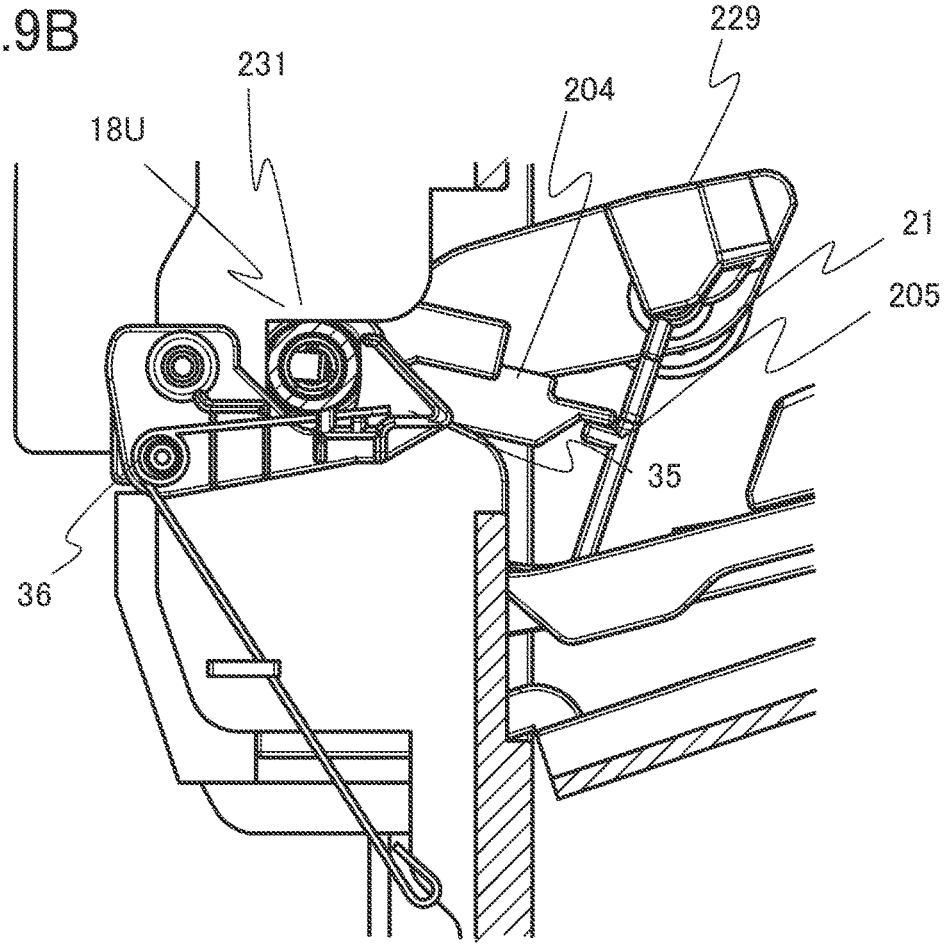
FIG. 9B is a side view illustrating a configuration for holding the manual sheet feed portion.

Next, using FIGS. 8 to 9B, a sheet feed unit 219 of this embodiment will be described in detail. As illustrated in FIGS. 8 and 9A, the sheet feed unit 219 includes a feed bearing gear 231, the feed coupling 32, the feed shaft 30, a pickup arm 229, the pickup roller 21, and the conveyance roller 22. Further, the sheet feed unit 219 includes an abutment member 205 and an abutment regulation arm 204.

The feed bearing gear 231 is held by the right cover 18 of the apparatus body 1A, and relatively rotatably supports the feed shaft 30. The feed coupling 32 is disposed at an end of the feed shaft 30 on the other side of the feed bearing gear 231.

Further, the pickup arm 229 is pivotably supported by the feed shaft 30, and the roller holding portion 29*a* rotatably supporting the pickup roller 21 is disposed in a substantially central portion of the pickup arm 229 in the width direction W. The roller holding portion 29*a* pivotably supports the abutment member 205 around a pivot shaft 205*s*. To be noted, the pivot shaft 205*s* is coaxial with the rotation center of the pickup roller 21.

The abutment regulation arm 204 is relatively rotatably supported with respect to the feed shaft 30, and adjacently arranged with respect to the roller holding portion 29*a* in the width direction W. To be noted, the abutment regulation arm 204 rotates independently from the pickup arm 229 and integrally with the feed bearing gear 231.

The feed bearing gear 231 includes a gear portion 231*a*, and the gear portion 231*a* engages with an idler gear, not shown, rotating in conjunction with the manual feed cover 25. Therefore, when the manual feed cover 25 is opened or closed with respect to the apparatus body 1A, the feed bearing gear 231 rotates, and the abutment regulation arm 204 pivots around the feed shaft 30 integrally with the feed bearing gear 231.

In an abutment position, described below, the abutment member 205 regulates the movement of the sheet S to the feed direction FD by abutting against the downstream end of the sheet S supported by the sheet supporting portion 70 in the feed direction FD.

As illustrated in FIG. 9A, the groove 18U is disposed in the right cover 18 of the apparatus body 1A, and the feed bearing gear 231 of the sheet feed unit 219 is engaged with the groove 18U. Further, the hook-shaped latch 35 is pivotably supported by the right cover 18, and, as illustrated in FIG. 9B, the latch 35 is urged upward by the torsion spring 36. Thereby, the detachment of the feed bearing gear 231 engaged with the groove 18U is prevented by the latch 35.

To be noted, as with the first embodiment, the pickup arm 229 pivots around the feed shaft 30 in conjunction with the arm pivot lever 37. Further, also in the second embodiment, as with the first embodiment, the drive transmission mechanism 60 (refer to FIG. 5B) transmitting the drive of the drive motor M to the arm pivot lever 37 and the feed gear 38 is included. Therefore, descriptions of the drive transmission mechanism 60 will be omitted herein.

To be noted, the feed bearing gear 231 and the feed coupling 32 of the sheet feed unit 219 are detachable with respect to the apparatus body 1A. That is, the sheet feed unit 219 is attachable to and detachable from the apparatus body 1A.

Feed Operation of Sheet Feed Unit

Figure 10A:
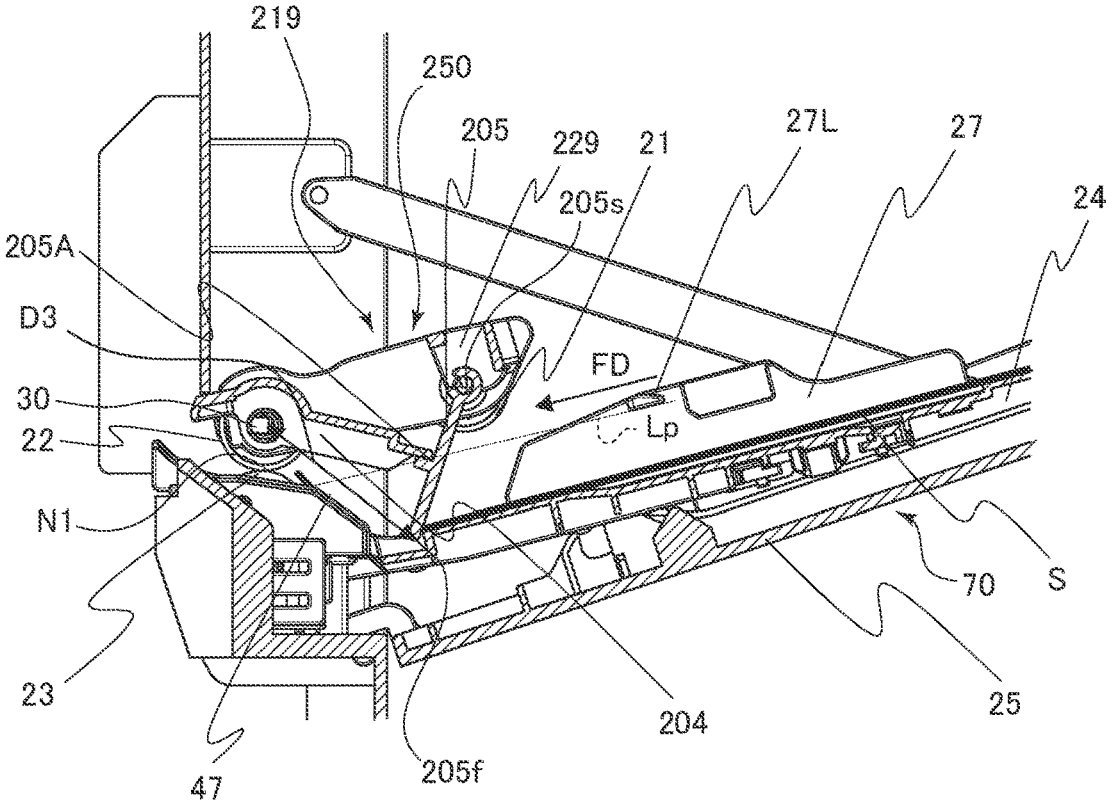
FIG. 10A is a cross-sectional view illustrating a sheet feed unit positioned in the waiting position.
Figure 10B:
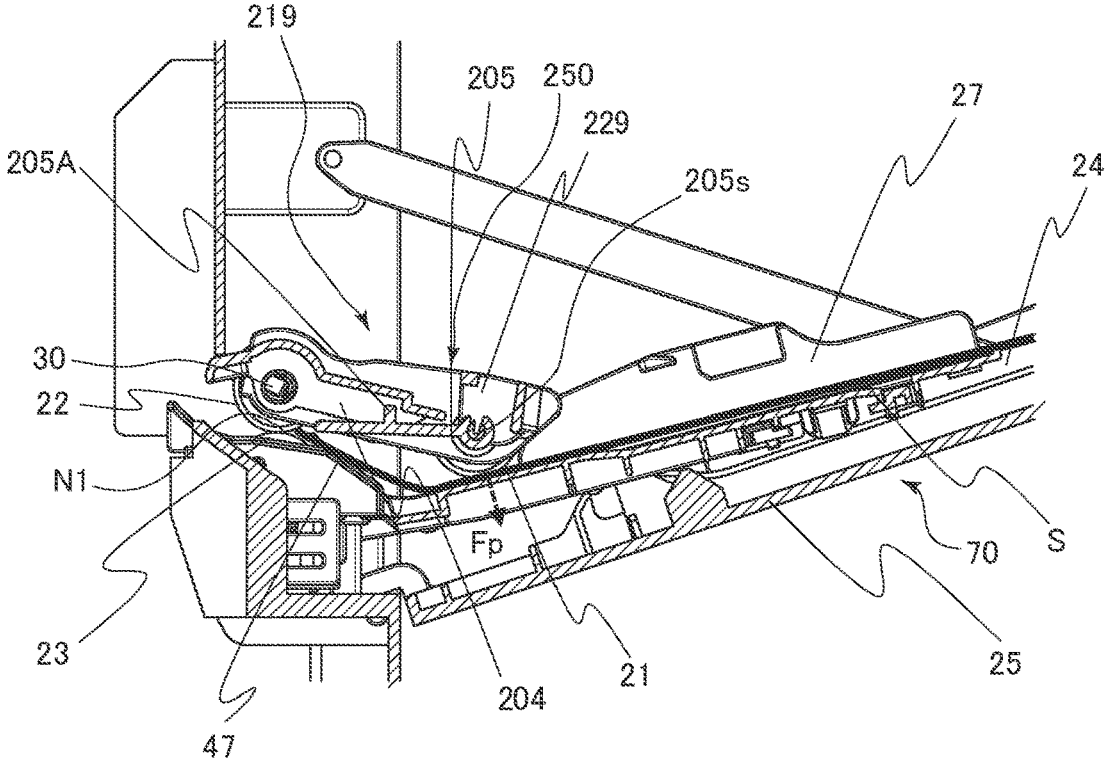
FIG. 10B is a cross-sectional view illustrating the sheet feed unit positioned in the sheet feed position.

Next, using FIGS. 10A and 10B, a feed operation of feeding the sheet S by the sheet feed unit 219 will be described. FIG. 10A is a cross-sectional view illustrating a state where the sheet feed unit 219 is positioned in a waiting position, and FIG. 10B is a cross-sectional view illustrating a state where the sheet feed unit 219 is positioned in a sheet feed position. To be noted, the sheet feed unit 219 is positioned in the waiting position in a state attached with respect to the apparatus body 1A. Further, the manual feed cover 25 is opened with respect to the apparatus body 1A when the sheet feed unit 219 is positioned in either the waiting position or the sheet feed position. That is, the sheet supporting portion 70 is positioned in a sheet supporting position capable of supporting the sheet.

First, using FIG. 10A, a state of the sheet feed unit 219 before starting the feed operation of feeding the sheet S will be described. For example, in a state where the sheet supporting portion 70 is opened with respect to the apparatus body 1A and the print job has not been input, the sheet feed unit 219 is positioned in the waiting position illustrated in FIG. 10A. At this time, the pickup roller 21 is arranged above the sheet position Lp (indicated by a dashed line in FIG. 10A) corresponding to the full load upper limit claw 27L disposed to the side regulating plate 27.

In particular, when the sheet feed unit 219 is positioned in the waiting position, the pickup arm 229 is positioned in an elevated position. The pickup roller 21 supported by the pickup arm 229 positioned in the elevated position is separated with respect to the sheet supported by the manual feed tray 24. At this time, the abutment member 205 is locked in the abutment position by the abutment regulation arm 204.

The abutment regulation arm 204 is, as described above, pivotable around the feed shaft 30 independently from the pickup arm 229, and is pivotable around the feed shaft 30 in conjunction with the opening/closing of the manual feed cover 25. In a case where the manual feed cover 25 is held in an opening state as illustrated in FIGS. 10A and 10B, if the pickup arm 229 ascends or descends, the abutment regulation arm 204 does not pivot.

A contact portion 205A is disposed on the abutment member 205, and, by abutting against the contact portion 205A, the abutment regulation arm 204, serving as the engagement member, is in an engagement state locking the abutment member 205 in the abutment position. Even if the abutment member 205 tries to pivot around the pivot shaft 205*s* in the clockwise direction, the abutment regulation arm 204, which is in the engagement state, regulates the pivot of the abutment member 205 by coming into contact with the contact portion 205A of the abutment member 205.

As described above, when the sheet feed unit 219 is positioned in the waiting position, the abutment member 205 is locked in the abutment position regulating the movement of the sheet S supported by the sheet supporting portion 70 to the feed direction FD. Thereby, the rush of the sheet S supported by the sheet supporting portion 70 to the separation nip N1 is suppressed, and it is possible to reduce the defective conveyance such as the double feeding. Therefore, it is possible to realize the stable feed operation.

For example, when the print job has been input and the feed operation has been started, as illustrated in FIG. 10A, by the action of the drive transmission mechanism 60 (refer to FIG. the pickup arm 229 descends from the elevated position. Then, the pickup roller 21 supported by the pickup arm 229 comes into contact with the sheet S with the contact pressure Fp. A position of the pickup arm 229 at this time is referred to as a lowered position, and a position of the sheet feed unit 219 is referred to as a sheet feed position. That is, when the sheet feed unit 219 is positioned in the sheet feed position, the pickup roller 21 comes into contact with the sheet S, and can feed the sheet S.

Further, by pivoting the pickup arm 229 from the elevated position to the lowered position, the abutment member 205 swings downward around the feed shaft 30. Thereby, the engagement of the abutment member 205 with the abutment regulation arm 204 is released, and the abutment regulation arm 204 turns to a release state releasing the lock of the abutment member 205 in the abutment position. Further, the abutment member 205 pivots in the clockwise direction by being pressed by the manual feed tray 24.

Further, as described in the first embodiment, by driving the drive motor M, the pickup roller 21 rotates. Therefore, the sheet S coming into contact with the pickup roller 21 with the contact pressure Fp is fed by the pickup roller 21, and, as illustrated in FIG. 10B, climbs a conveyance guide 47 and is guided to the separation nip N1. The sheet S presses the abutment member 205, and is conveyed to the downstream in the feed direction FD by the separation nip N1. As described above, since, by lowering the pickup arm 229 to the lowered position, the abutment regulation arm 204 has turned to the release state, it becomes possible to convey the sheet S with the sheet S pushing the abutment member 205 upward.

When the drive motor M has been further rotated, by the action of the drive transmission mechanism 60 (refer to FIG. 5A), the pickup arm 229 pivots around the feed shaft in a counter-clockwise direction in FIG. 10B. Thereby, as illustrated in FIG. 10A, the pickup arm 229 ascends from the lowered position to the elevated position, and the sheet feed unit 219 again returns to the waiting position.

As described above, the sheet feed unit 219 feeds the sheet loaded on the manual feed tray 24 one sheet at a time until the print job is complete. In particular, the pickup roller 21 ascends and descends every time when feeding one sheet of the sheet, and feeds the sheet S when coming into contact with the sheet S with the contact pressure Fp. Further, the lock of the abutment member 205 in the abutment position is released by the descent of the pickup roller 21, and the abutment member 205 is pushed upward by the sheet S. Therefore, the abutment member 205 does not inhibit the feeding of the sheet S. When the print job is complete, the drive motor M stops in a state where the sheet feed unit 219 is positioned in the waiting position.

Storage of Sheet Feed Unit

Next, using FIGS. 11A and 11B, a configuration for storing the sheet feed unit 219 in the apparatus body 1A will be described. As illustrated in FIG. 10A described above, in the state where the sheet feed unit 219 is positioned in the waiting position, the sheet supporting portion is positioned in the sheet supporting position in which the sheet supporting portion 70 is opened with respect to the apparatus body 1A. At this time, the abutment member 205 is positioned with respect to a holding portion 250 including the pickup arm 229 and the abutment regulation arm 204 so as to be positioned in the abutment position (refer to FIGS. 10A and 10B and FIGS. 11A and 11B). The holding portion 250 holds the pickup roller 21 and the abutment member 205.

Figure 11A:
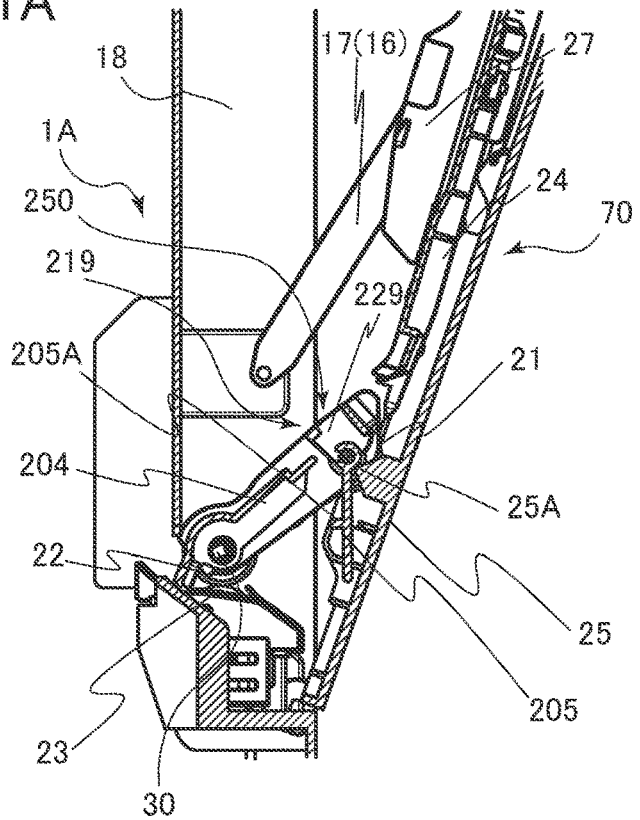
FIG. 11A is a cross-sectional view illustrating a state of the sheet feed unit on the way to being stored in the interior of the apparatus body.

As illustrated in FIG. 11A, when closing the sheet supporting portion 70 with respect to the apparatus body 1A from the sheet supporting position toward a storage position (refer to FIG. 11B), the manual feed tray 24 is slidingly moved along the manual feed cover 25 upward by the tray links 16 and 17. Thereby, space for storing the sheet feed unit 219 is created.

Further, at this time, in conjunction with a closing operation of the manual feed cover the abutment regulation arm 204 pivots around the feed shaft 30 in the counter-clockwise direction. Thereby, the abutment regulation arm 204 is separated from the contact portion 205A of the abutment member 205, and turns from the engagement state locking the abutment member 205 in the abutment position to the release state releasing the lock. Then, the pivot regulation of the abutment member 205 is released.

When the sheet supporting portion 70 has been further closed with respect to the apparatus body 1A in the counter-clockwise direction, the manual feed cover 25 comes into contact with the pickup arm 229, and the pickup arm 229 also pivots around the feed shaft 30 in the counter-clockwise direction.

When the manual feed cover 25 has exceeded a certain closing angle, the mountain-shaped rib 25A, serving as the pressing portion, disposed on the manual feed cover 25 starts coming into contact with the abutment member 205. Then, by being pressed by the mountain-shaped rib 25A pivoting together with the manual feed cover 25, the abutment member 205 pivots with respect to the pickup arm 229 around the pivot shaft 205*s* in the clockwise direction.

Figure 11B:
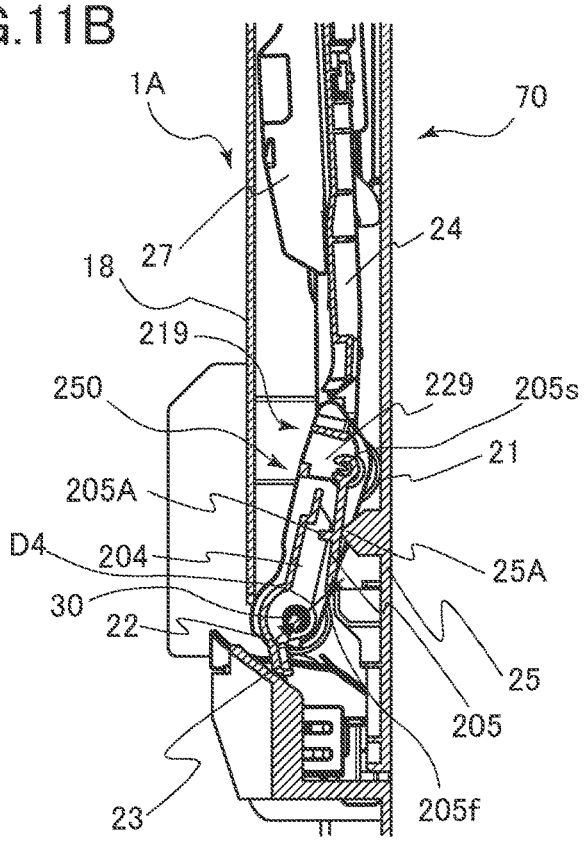
FIG. 11B is cross-sectional view illustrating a state of the sheet feed unit stored in the interior of the apparatus body.

Then, as illustrated in FIG. 11B, the abutment member 205 is stored in the interior of the apparatus body 1A together with the sheet feed unit 219. A position of the sheet feed unit 219 at this time is referred to as the storage position, serving as the second storage position, and a position of the abutment member 205 is referred to as the storage position, serving as the third storage position. In other words, when the sheet feed unit 219 moves from the waiting position to the storage position, by being pressed by the mountain-shaped rib 25A, the abutment member 205 moves toward the storage position together with the sheet feed unit 219. That is, when the sheet feed unit 219 moves from the waiting position to the storage position, the abutment member 205 moves with respect to the holding portion 250 with positioning with respect to the holding portion 250 released. Further, the sheet feed unit 219 is pivotable around the feed shaft 30 to the sheet feed position, the waiting position, and the storage position.

Further, by closing the manual feed cover 25 in the counter-clockwise direction, the abutment regulation arm 204 also pivots around the feed shaft 30, and is stored in the interior of the apparatus body 1A.

Here, when viewed in an axial direction of the feed shaft 30, that is, in the width direction W, as illustrated in FIG. 10A, a distance between a tip 205*f* of the abutment member 205 positioned in the abutment position and the axial center of the feed shaft 30 is referred to as a distance D3. The tip 205*f* is a portion farthest from the pivot shaft 205*s* in the abutment member 205. Further, as illustrated in FIG. 11B, a distance between the tip 205*f* of the abutment member 205 positioned in the storage position and the axial center of the feed shaft 30 is a distance D4. The distance D4 is shorter than the distance D3. To be noted, while, in this embodiment, the distances D3 and D4 are the distances between the tip 205*f* and the axial center of the feed shaft if distances between the tip 205*f* and the outer circumferential surface of the feed shaft 30 are treated as the distances D3 and D4, the distance D4 becomes shorter than the distance D3.

As described above, when pivoting the sheet supporting portion 70 and the sheet feed unit 219 to the storage position, the abutment member 205 pivots toward the feed shaft 30 so as to fit within a volume of the pickup arm 229 and the abutment regulation arm 204. That is, since, in conjunction with the pivot of the sheet feed unit 219 from the waiting position to the storage position, the abutment member 205 pivots from the abutment position to the storage position, it is possible to compactly store the sheet feed unit 219, including the abutment member 205, in the apparatus body 1A. Therefore, it is possible to compactify the apparatus body 1A.

Further, in a state where the sheet feed unit 219 is positioned in the waiting position as illustrated in FIG. 10A, the abutment member 205 is securely locked in the abutment position by the abutment regulation arm 204 which is in the engagement state. Thereby, the rush of the sheet S supported by the manual feed tray 24 to the separation nip N1 is suppressed, and it is possible to reduce the defective conveyance.

Further, the sheet feed unit 219 is attachable to and detachable from the apparatus body 1A, and the abutment member 205 is disposed in the sheet feed unit 219. Therefore, if, for example, the user pushes the sheet S with respect to the abutment member 201, which is locked in the abutment position, with excessive force and the abutment member 205 is deformed or damaged, it is possible to easily replace the abutment member 205 and improve the maintainability.

OTHER EMBODIMENTS

To be noted, while, in either of the embodiments described above, the sheet feed units 19 and 219 are attachable to and detachable from the apparatus body 1A, it is not limited to this. For example, it is acceptable to secure the sheet feed units 19 and 219 to the apparatus body 1A with a screw.

Further, while the abutment regulation member 202 and the movement regulation member 203 of the first embodiment are disposed in the sheet feed unit 19, it is not limited to this. For example, it is acceptable to dispose either one or both of the abutment regulation member 202 and the movement regulation member 203 to the apparatus body 1A or the sheet supporting portion 70.

Further, while the abutment regulation arm 204 of the second embodiment is disposed to the sheet feed unit 219, it is not limited to this. For example, it is acceptable to dispose the abutment regulation arm 204 to the apparatus body 1A or the sheet supporting portion 70.

Further, while, in either of the embodiments described above, the pickup roller 21 and the conveyance roller 22 are constituted by a roller, it is not limited to this. For example, it is acceptable that the pickup roller 21 and the conveyance roller 22 are constituted by other rotary members such as a belt.

Further, while the abutment member 201 of the first embodiment and the abutment member 205 of the second embodiment are respectively formed in a claw shape and a rod shape, it is not limited to this. That is, shapes or materials of the abutment members 201 and 205 are not limited, and can be set arbitrarily. However, with a view to storing the abutment members 201 and 205 in the apparatus body 1A, the abutment members 201 and 205 are preferably in an elongated shape.

Further, while, in either of the embodiments described above, the descriptions are provided by using the printer 1 of the electrophotographic system, the present disclosure is not limited to this. For example, it is possible to apply the present disclosure to an image forming apparatus of an ink jet system which forms the image on the sheet by ejecting a liquid ink through a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-087035, filed May 27, 2022, which is hereby incorporated by reference herein in its entirety.

What is claimed is:

1. A sheet feeding apparatus comprising:

an apparatus body;

a sheet supporting portion configured to be movably supported with respect to the apparatus body between a sheet supporting position in which the sheet supporting portion is capable of supporting a sheet and a first storage position in which the sheet supporting portion is stored with respect to the apparatus body; and a sheet feed unit including:

a sheet feed portion configured to feed the sheet supported by the sheet supporting portion in a sheet feed direction;

an abutment member configured to regulate a movement of the sheet to the sheet feed direction by abutting against a downstream end, of the sheet, in the sheet feed direction, the sheet feed unit being movably supported with respect to the apparatus body among a sheet feed position in which the sheet feed portion is capable of feeding the sheet by coming into contact with the sheet supported by the sheet supporting portion, a waiting position in which the sheet feed portion is separated from the sheet supported by the sheet supporting portion, and a second storage position in which the sheet feed unit is stored with respect to the apparatus body, the abutment member being positioned in an abutment position in a case where the sheet feed unit is positioned in the waiting position, the abutment member being positioned in a third storage position in a case where the sheet feed unit is positioned in the second storage position, the abutment position being a position in which the abutment member regulates movement of the sheet supported by the sheet supporting portion to the sheet feed direction, the third storage position being a position in which the abutment member is stored with respect to the apparatus body, and an engagement member configured to turn into an engagement state and a release state, the engagement state being a state in which the engagement member locks the abutment in the abutment position, the release state being a state in which the engagement member releases a lock of the abutment in the abutment position, wherein the sheet feed unit is positioned in the sheet feed position or the waiting position and is exposed to an outside of the sheet feeding apparatus in a case where the sheet supporting portion is positioned in the sheet supporting position, wherein the sheet feed unit is positioned in the second storage position and is not exposed to the outside of the sheet feeding apparatus in a case where the sheet supporting portion is positioned in the first storage position, wherein the abutment member moves together with the sheet feed unit so as to be stored in the apparatus body in a case where the sheet feed unit moves from the waiting position to the second storage position, wherein the engagement member turns into the engagement state in a case where the sheet feed unit is positioned in the waiting position, and turns into the release state in a case where the sheet feed unit is positioned in the sheet feed position or the second storage position, and wherein the sheet supporting portion includes a pressing portion configured to turn the engagement member from the engagement state to the release state by pressing the engagement member in a case where the sheet supporting portion moves from the sheet supporting position to the first storage position.

2. The sheet feeding apparatus according to claim 1, wherein the abutment member is configured to pivot around a pivot shaft, wherein the sheet feed unit includes a conveyance rotary member configured to convey the sheet fed by the sheet feed portion, the sheet feed unit being configured to pivot around a rotation shaft of the conveyance rotary member among the sheet feed position, the waiting position, and the second storage position, and wherein, when viewed in an axial direction of the pivot shaft, a distance between a tip, farthest in the abutment member from the pivot shaft of the abutment member, of the abutment member positioned in the third storage position and the rotation shaft of the conveyance rotary member is shorter than a distance between the tip of the abutment member positioned in the abutment position and the rotation shaft of the conveyance rotary member.

3. The sheet feeding apparatus according to claim 1, wherein the sheet feed unit includes the engagement member.

4. The sheet feeding apparatus according to claim 1, wherein the sheet feed unit includes a holding member configured to hold the engagement member in the engagement state in a case where the sheet feed unit is positioned in the waiting position.

5. The sheet feeding apparatus according to claim 1, wherein the engagement member is configured to move in conjunction with the sheet supporting portion, and is separated from the abutment member in a case where the sheet supporting portion moves from the sheet supporting position to the first storage position.

6. The sheet feeding apparatus according to claim 1, wherein the sheet feed unit is configured to be attachable to and detachable from the apparatus body.

7. The sheet feeding apparatus according to claim 1, wherein the sheet supporting portion includes a cover constituting a part of an exterior surface of the sheet feeding apparatus.

8. An image forming apparatus comprising:

the sheet feeding apparatus according to claim 1; and an image forming unit configured to form an image on the sheet fed by the sheet feeding apparatus.

9. A sheet feeding apparatus comprising:

an apparatus body;

a sheet supporting portion configured to be movably supported with respect to the apparatus body between a sheet supporting position in which the sheet supporting portion is capable of supporting a sheet and a first storage position in which the sheet supporting portion is stored with respect to the apparatus body;

a sheet feed unit including:

a sheet feed portion configured to feed the sheet supported by the sheet supporting portion in a sheet feed direction;

an abutment member configured to regulate a movement of the sheet to the sheet feed direction by abutting against a downstream end, of the sheet, in the sheet feed direction, the sheet feed unit being movably supported with respect to the apparatus body among a sheet feed position in which the sheet feed portion is capable of feeding the sheet by coming into contact with the sheet supported by the sheet supporting portion, a waiting position in which the sheet feed portion is separated from the sheet supported by the sheet supporting portion, and a second storage position in which the sheet feed unit is stored with respect to the apparatus body, the abutment member being positioned in an abutment position in a case where the sheet feed unit is positioned in the waiting position, the abutment member being positioned in a third storage position in a case where the sheet feed unit is positioned in the second storage position, the abutment position being a position in which the abutment member regulates a movement of the sheet supported by the sheet supporting portion to the sheet feed direction, the third storage position being a position in which the abutment member is stored with respect to the apparatus body;

an engagement member configured to turn into an engagement state and a release state, the engagement state being a state in which the engagement member locks the abutment member in the abutment position, the release state being a state in which the engagement member releases a lock of the abutment member in the abutment position; and a holding member configured to hold the engagement member in the engagement state in a case where the sheet feed unit is positioned in the waiting position;

wherein the sheet feed unit is positioned in the sheet feed position or the waiting position and is exposed to an outside of the sheet feeding apparatus in a case where the sheet supporting portion is positioned in the sheet supporting position, wherein the sheet feed unit is positioned in the second storage position and is not exposed to the outside of the sheet feeding apparatus in a case where the sheet supporting portion is positioned in the first storage position, wherein the abutment member moves together with the sheet feed unit so as to be stored in the apparatus body in a case where the sheet feed unit moves from the waiting position to the second storage position, wherein the engagement member turns into the engagement state in a case where the sheet feed unit is positioned in the waiting position, and turns into the release state in a case where the sheet feed unit is positioned in the sheet feed position or the second storage position, wherein the sheet feed unit includes a holding member configured to hold the engagement member in the engagement state in a case where the sheet feed unit is positioned in the waiting position, wherein the abutment member is configured to be pivotably supported by the holding member, and wherein the engagement member turns from the engagement state to the release state by being pressed by the holding member in a case where the sheet feed unit moves from the waiting position to the sheet feed position.

10. An image forming apparatus comprising:

the sheet feeding apparatus according to claim 9; and an image forming unit configured to form an image on the sheet fed by the sheet feeding apparatus.

11. The sheet feeding apparatus according to claim 9, wherein the abutment member is configured to pivot around a pivot shaft, wherein the sheet feed unit includes a conveyance rotary member configured to convey the sheet fed by the sheet feed portion, the sheet feed unit being configured to pivot around a rotation shaft of the conveyance rotary member among the sheet feed position, the waiting position, and the second storage position, and wherein, when viewed in an axial direction of the pivot shaft, a distance between a tip, farthest in the abutment member from the pivot shaft of the abutment member, of the abutment member positioned in the third storage position and the rotation shaft of the conveyance rotary member is shorter than a distance between the tip of the abutment member positioned in the abutment position and the rotation shaft of the conveyance rotary member.

12. The sheet feeding apparatus according to claim 9, wherein the sheet feed unit includes the engagement member.

13. The sheet feeding apparatus according to claim 9, wherein the sheet feed unit is configured to be attachable to and detachable from the apparatus body.

14. The sheet feeding apparatus according to claim 9, wherein the sheet supporting portion includes a cover constituting a part of an exterior surface of the sheet feeding apparatus.

15. A sheet feeding apparatus comprising:

an apparatus body;

a sheet supporting portion configured to be movably supported with respect to the apparatus body between a sheet supporting position in which the sheet supporting portion is capable of supporting a sheet and a first storage position in which the sheet supporting portion is stored with respect to the apparatus body;

a sheet feed unit including:

a sheet feed portion configured to feed the sheet supported by the sheet supporting portion in a sheet feed direction; and an abutment member configured to regulate a movement of the sheet to the sheet feed direction by abutting against a downstream end, of the sheet, in the sheet feed direction, the sheet feed unit being movably supported with respect to the apparatus body among a sheet feed position in which the sheet feed portion is capable of feeding the sheet by coming into contact with the sheet supported by the sheet supporting portion, a waiting position in which the sheet feed portion is separated from the sheet supported by the sheet supporting portion, and a second storage position in which the sheet feed unit is stored with respect to the apparatus body, the abutment member being positioned in an abutment position in a case where the sheet feed unit is positioned in the waiting position, the abutment member being positioned in a third storage position in a case where the sheet feed unit is positioned in the second storage position, the abutment position being a position in which the abutment member regulates a movement of the sheet supported by the sheet supporting portion to the sheet feed direction, the third storage position being a position in which the abutment member is stored with respect to the apparatus body, and an engagement member configured to turn into an engagement state and a release state, the engagement state being a state in which the engagement member locks the abutment member in the abutment position, the release state being a state in which the engagement member releases a lock of the abutment member in the abutment position, wherein the sheet feed unit is positioned in the sheet feed position or the waiting position and is exposed to an outside of the sheet feeding apparatus in a case where the sheet supporting portion is positioned in the sheet supporting position, wherein the sheet feed unit is positioned in the second storage position and is not exposed to the outside of the sheet feeding apparatus in a case where the sheet supporting portion is positioned in the first storage position, wherein the abutment member moves together with the sheet feed unit so as to be stored in the apparatus body in a case where the sheet feed unit moves from the waiting position to the second storage position, wherein the engagement member turns into the engagement state in a case where the sheet feed unit is positioned in the waiting position, and turns into the release state in a case where the sheet feed unit is positioned in the sheet feed position or the second storage position, wherein the engagement member is configured to move in conjunction with the sheet supporting portion, and is separated from the abutment member in a case where the sheet supporting portion moves from the sheet supporting position to the first storage position, and wherein the sheet supporting portion includes a pressing portion configured to press the abutment member toward the third storage position in a case where the sheet supporting portion moves from the sheet supporting position to the first storage position.

16. The sheet feeding apparatus according to claim 15, wherein the abutment member is configured to pivot around a pivot shaft, wherein the sheet feed unit includes a conveyance rotary member configured to convey the sheet fed by the sheet feed portion, the sheet feed unit being configured to pivot around a rotation shaft of the conveyance rotary member among the sheet feed position, the waiting position, and the second storage position, and wherein, when viewed in an axial direction of the pivot shaft, a distance between a tip, farthest in the abutment member from the pivot shaft of the abutment member, of the abutment member positioned in the third storage position and the rotation shaft of the conveyance rotary member is shorter than a distance between the tip of the abutment member positioned in the abutment position and the rotation shaft of the conveyance rotary member.

17. The sheet feeding apparatus according to claim 15, wherein the sheet feed unit includes the engagement member.

18. The sheet feeding apparatus according to claim 15, wherein the sheet feed unit is configured to be attachable to and detachable from the apparatus body.

19. The sheet feeding apparatus according to claim 15, wherein the sheet supporting portion includes a cover constituting a part of an exterior surface of the sheet feeding apparatus.

20. An image forming apparatus comprising:

the sheet feeding apparatus according to claim 10; and an image forming unit configured to form an image on the sheet fed by the sheet feeding apparatus.

* * * * *